US005446525A

United States Patent [19]

Kobayashi

[11] Patent Number: 5,446,525

[45] Date of Patent: Aug. 29, 1995

[54] IMAGE BEARING MEMBER MOUNTING METHOD

[75] Inventor: Hiroo Kobayashi, Yokohama, Japan

[73] Assignee: Canon Kabushiki Kaisha, Tokyo, Japan

[21] Appl. No.: 266,457

[22] Filed: Jun. 27, 1994

[30] Foreign Application Priority Data

Jun. 25, 1993 [JP] Japan ..... 5-155377

[51] Int. Cl.[6] ..... G03G 15/00

[52] U.S. Cl. ..... 355/210; 355/211

[58] Field of Search ..... 355/210, 211, 200; 346/153.1, 160

[56] References Cited

U.S. PATENT DOCUMENTS

| | | | |
|---|---|---|---|
| 4,575,221 | 3/1986 | Onoda et al. . | |
| 4,639,119 | 1/1987 | Isaka . | |
| 4,873,548 | 10/1989 | Kobayashi et al. | 355/200 |
| 4,888,620 | 12/1989 | Fujino et al. | 355/211 |
| 4,975,744 | 12/1990 | Ebata et al. | 355/211 |
| 5,023,660 | 6/1991 | Ebata et al. | 355/200 |
| 5,128,715 | 7/1992 | Furuyama | 355/200 |
| 5,210,574 | 5/1993 | Kita | 355/211 |
| 5,212,520 | 5/1993 | Toyofuku | 355/200 |
| 5,221,943 | 6/1993 | Hasegawa | 355/200 X |
| 5,294,960 | 3/1994 | Nomura et al. | 355/210 |
| 5,331,373 | 7/1994 | Nomura et al. | 355/200 |
| 5,345,294 | 9/1994 | Nomura et al. | 355/200 |

*Primary Examiner*—R. L. Moses

*Attorney, Agent, or Firm*—Fitzpatrick, Cella, Harper & Scinto

[57] ABSTRACT

A photosensitive drum mounting member includes a base member; a first conductive member projected from one side of the base member; a second conductive member, projected from the other side of the base member, and electrically connected with the first conductive member; a cylindrical member of plastic material on a surface of the second conductive member, the cylindrical member covering an inside part of the second conductive member from its end; and an extension from the base member.

23 Claims, 14 Drawing Sheets

| TONER CONTAINER | STRENGTH AGAINST PULL (kgf) |
|---|---|
| EX. 1 | 2.1 |
| EX. 2 | 2.2 |
| COMP. EX. 1 | 5.1 |

FIG. 19

| PC | STRENGTH AGAINST OPENING (kgf) |
|---|---|
| EX. 1 | 3.6 |
| EX. 2 | 3.8 |
| COMP. EX. 1 | 8.1 |

FIG. 20

| | STRENGTH AGAINST PULL (kgf) | STRENGTH AGAINST OPENING (kgf) |
|---|---|---|
| EX. 3 | 3.2 | 4.3 |
| EX. 4 | 3.4 | 4.5 |
| COMP. EX. 2 | 6.7 | 10.8 |

FIG. 21

| | STRENGTH AGAINST PRESSURE (gf) | FALLING TEST |
|---|---|---|
| EX. 3 | 510 | NO TNR LEAK |
| EX. 4 | 540 | NO TNR LEAK |
| COMP. EX. 2 | 350 | TNR LEAK |

FIG. 22

| | EXPANSION (mm) | STABILITY AGAINST TEARING |
|---|---|---|
| EX. 5 | 0.75 | SMOOTH |
| EX. 6 | 0.78 | SMOOTH |

FIG. 23

| | REMAINING SEALANT | IMPROPER IMAGE |
|---|---|---|
| EX. 1 | 0 | 0 |
| EX. 2 | 0 | 0 |
| COMP. EX. 1 | 5 | 3 |

FIG. 24

IMAGE BEARING MEMBER MOUNTING METHOD

FIELD OF THE INVENTION AND RELATED ART

The present invention relates to an image bearing member mounting method, an image bearing member mounting method and a process cartridge having the image bearing member, and an image forming apparatus.

An electrophotographic type image forming machines are widely used as in copying machines or the like. In such an apparatus, a surface of an electrophotographic photosensitive drum which is rotated is uniformly charged, and a selective image exposure thereof is effected to form a latent image thereon. The latent image is visualized with toner, and the toner image is transferred onto a recording material.

In such an apparatus, in order to rotatably support a photosensitive drum, a flange is securedly fixed to each of the longitudinal ends of the photosensitive drum in the form of a cylinder. A supporting shaft is penetrated through bores of the flanges to support it. The photosensitive drum is required to be electrically grounded. Conventionally, the supporting shaft is made of metal material so that the photosensitive drum is electrically grounded through the supporting shaft. When the supporting shaft of metal is inserted through the bores of the flanges, one end of the supporting shaft is contacted to a contact of the photosensitive drum, and the other end of the supporting shaft is connected with an electrical ground of the main assembly of the apparatus, so that the grounding of the photosensitive drum is established.

However, the flange fixed to the end of the photosensitive drum is usually made of resin material. When the flange is supported by metal member, the friction occurs between the metal shaft and the resin flange when the photosensitive drum is rotated. Then, there occurs a liability of poor sliding property with the result that the bores of the flanges are scraped or that a noise is produced.

SUMMARY OF THE INVENTION

Accordingly, it is a principal object of the present invention to provide an electrophotographic photosensitive drum mounting member, mounting method, a process cartridge and an image forming apparatus in which smooth rotation of the electrophotographic photosensitive member is assured.

It is another object of the present invention to provide a mounting member for an electrophotographic photosensitive member, a mounting method thereof, a process cartridge and an image forming apparatus in which noise is not produced when the photosensitive drum is rotated.

It is a further object of the present invention to provide an electrophotographic photosensitive drum mounting member, a mounting method therefor, a process cartridge and an image forming apparatus in which the sliding between the photosensitive drum and a supporting shaft therefor is good enough so that the flange of the drum is not scraped and that no noise is produced.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 19 is a table of experimental results of strength of a tear tape against pulling.

FIG. 20 is a table of experimental results of strength against opening of the process cartridge.

FIG. 21 is a table of experimental results of strength against opening of the process cartridge and a strength of the tear tape against pulling.

FIG. 22 is a table of experimental results about strengths of the toner container and the process cartridge against pressure and falling test.

FIG. 23 is a table of experimental results about tear expansion of the cover seal and stability of tearing, when the tear tape is pulled.

FIG. 24 is a table of experimental results about residual sealant and improper image formation, when the tear tape is pulled out.

DESCRIPTION OF THE PREFERRED EMBODIMENTS

Referring to the accompanying drawings, first embodiment of the present invention will be described.

Embodiment 1

Figure 1:
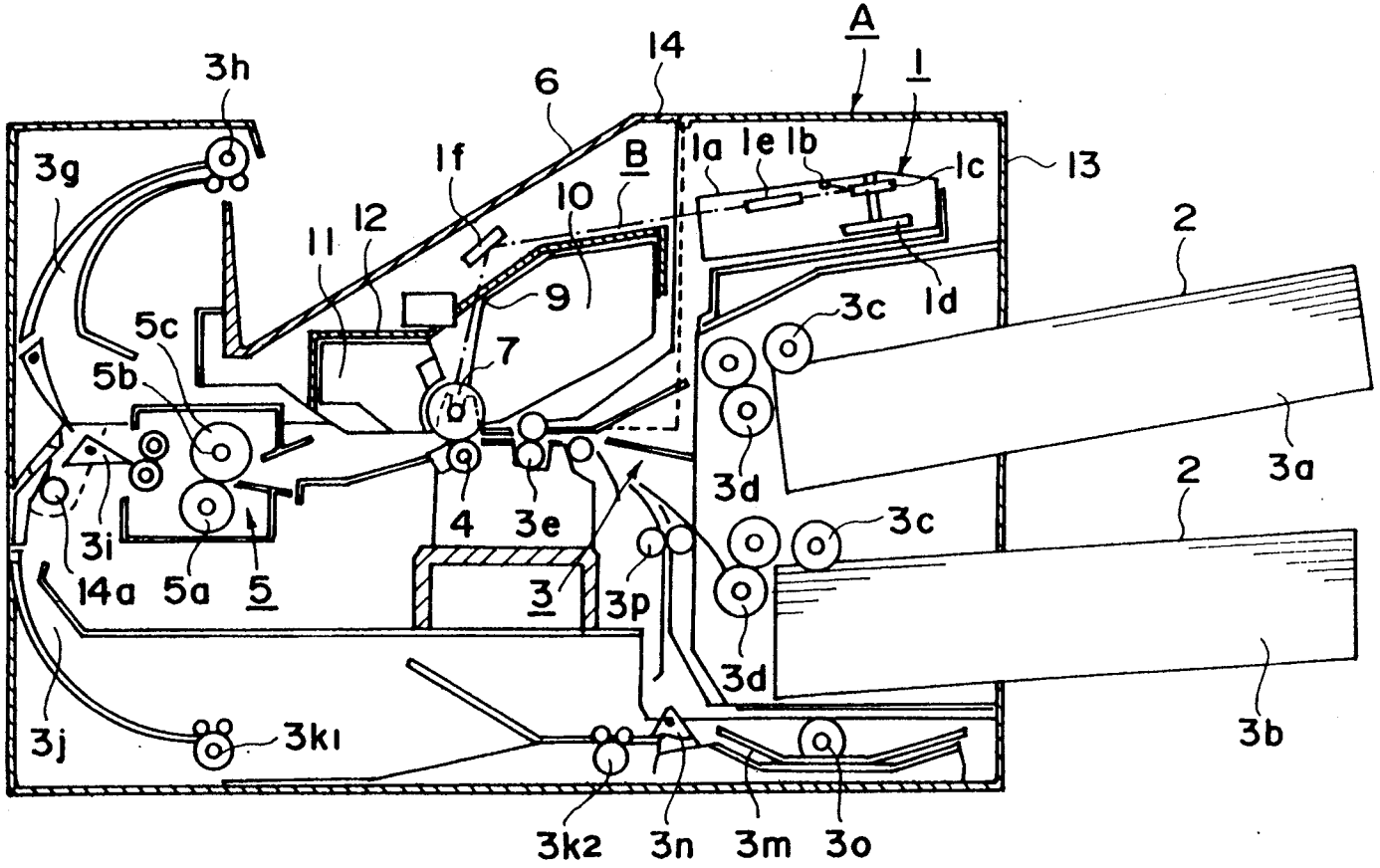
FIG. 1 is a sectional view of an image forming apparatus according to an embodiment of the present invention.
Figure 2:
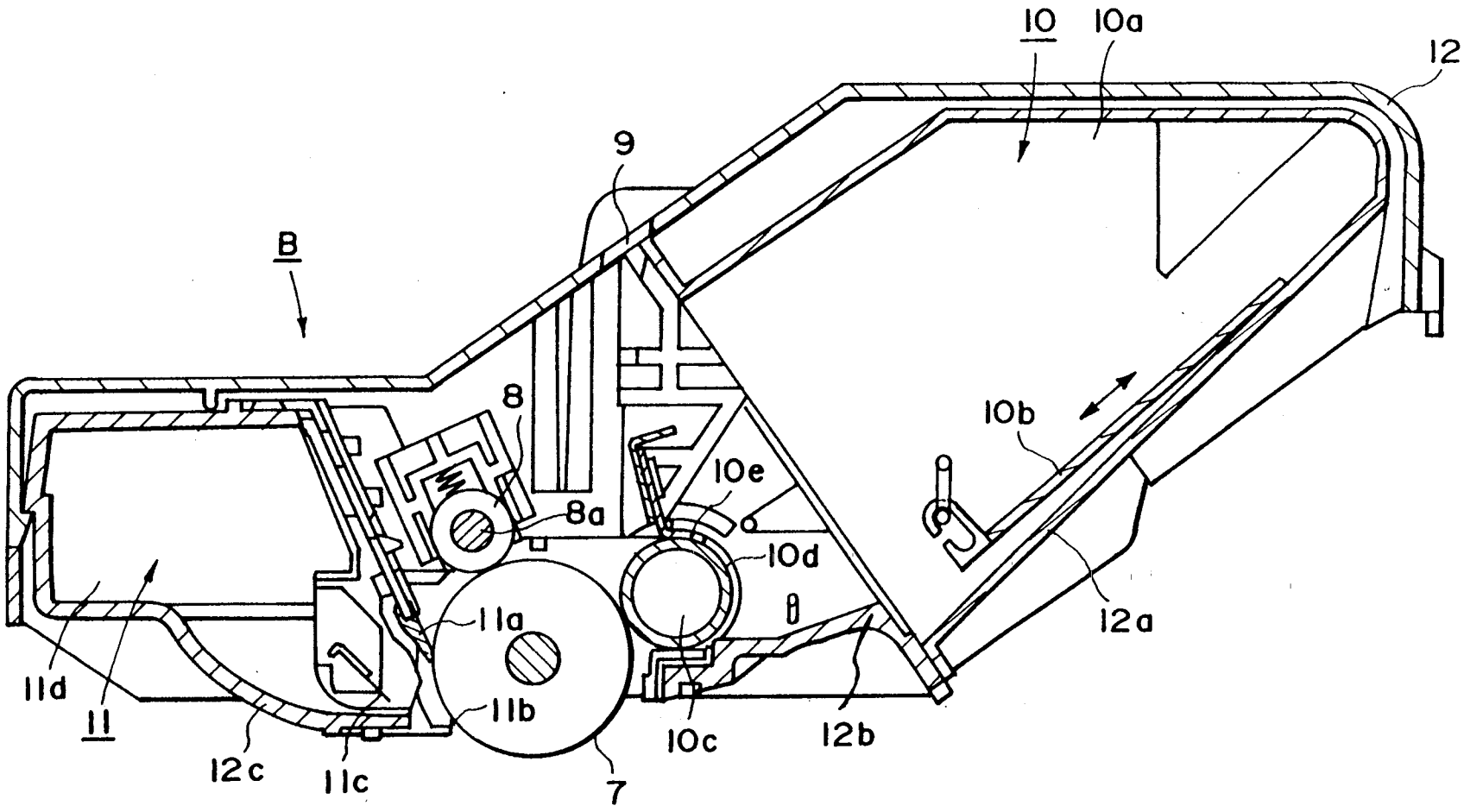
FIG. 2 is a sectional view of a process cartridge according to an embodiment of the present invention.

FIG. 1 is a sectional view of an image forming apparatus loaded with a process cartridge, according to an embodiment of the present invention. FIG. 2 is a sectional view of the process cartridge.

General Description

The image forming apparatus A, as shown in FIG. 1, projects light image bearing image information from an optical system 1 to a photosensitive drum which is an example of the image bearing member, and a developed image is formed on the photosensitive member. In synchronism with the toner image formation, the recording material 2 is fed by feeding means 3, and an image forming station which is in the form of a cartridge (process cartridge B), the toner image is transferred onto a recording material from the photosensitive drum by transfer means 4. The recording material 2 is fed to fixing means 5, where the toner image is fixed on the recording material, and the recording material is discharged to a discharge station.

A process cartridge B constituting the image forming station, as shown in FIG. 2, is such that the photosensitive drum 7 is rotated while the surface thereof is uniformly charged by charging means 8, and the light image from the optical system 1 is projected onto the photosensitive drum 7 through the exposure station 9, so that a latent image is formed. The latent image is developed into a toner image by developing means 10. The toner is image is transferred therefrom onto the recording material 2 by the transfer means 4, and thereafter, the residual toner remaining on the photosensitive drum 7 is removed by cleaning means. Various parts such as the photosensitive drum 7 or the like are contained in a housing, so that they constitute a cartridge.

The description will be made as to various parts of the image forming apparatus A and the process cartridge B. The description will be further made as to a mounting member 15 for mounting the photosensitive drum 7 onto a cleaning container 12*c*, and a sealing member mounted to a toner container 12*a* around an opening thereof.

Image Forming Apparatus

The description will be made as to an optical system, feeding means, transfer means, fixing means and cartridge mounting means in this order.

Optical System

The optical system products the light beam carrying image information provided by an external apparatus or the like, onto the photosensitive member 7. As shown in FIG. 1, it comprises an optical unit 1*a* containing a laser diode 1*b*, a polygonal mirror 1*c*, a scanner motor 1*d* and an image forming lens 1*e*.

When an image signal is sent from an external equipment such as a computer or word processor, the laser diode 1*b* emits light in response to the imaging signal, and the emitted light is projected as the imaging beam to the polygonal mirror 1*c*, which is being rotated at a high speed by a scanner motor 1*d*. The imaging beam reflected by the polygonal mirror 1*c* is projected through the image forming lens 1*e* and is effected by the mirror 1*f* onto the photosensitive drum 7, exposing selectively the surface thereof. As a result, a latent image is formed on the drum in accordance with the image information.

Recording Material Feeding Means

The description will be made as to the structure of feeding means 3 for feeding the recording material (recording sheet, OHP sheet, cloth or thin sheet, for example). In this embodiment, two cassettes 3*a* and 3*b* are usable, so that two kinds of recording materials 2 can be selectively fed. In addition, one side or both-side printing is possible.

When either of cassette 3*a* or cassette 3*b* is selected, the topmost sheet is fed by a pick-up roller 3*c* and a separation roller pair 3*d* in the selected cassette. Then, it is fed to a registration roller pair 3*e*. The registration roller pair 3*e* is driven in synchronism with the image forming operation to feed the recording material 2 to an image transfer position where the photosensitive drum 7 and the transfer roller 4 are contacted.

The recording material 2 having received the toner image is fed to image fixing means 5, where the toner image is fixed. In the case of a single side printing mode selected, the recording material is fed along the discharge passage 3*g* by an intermediate feeding roller pair 3*f*, and is then discharged to a discharge portion 6 by a discharging roller pair 3*h* with the record side facing down.

In the case of duplex printing (both-side printing), a flapper 3*i* swings so that the recording material after having received an image on one side is fed to a refeeding passage 3*j* by intermediate feeding roller pair 3*f*, and is temporarily stored in a refeeding station by refeeding rollers 3*k*1 and 3*k*2. When it is to be refed, the flapper 3*n* swings to permit the recording material stored in the refeeding station 3*m* by a pick-up roller 3*o* and feeding roller pairs 3*p* to the registration roller pairs 3*e*. Then, the opposite side of the recording material is subjected to the image formation. (Transfer means)

The transfer means 4 transfers the toner image formed on the photosensitive drum 7 onto a recording material. The transfer means 4 of this embodiment, as shown in FIG. 1, is constituted by a transfer roller 4. By the transfer roller 4 the recording material 2 is pressed to the photosensitive drum 7 in the process cartridge B, while the transfer roller 4 is supplied with a voltage having a polarity opposite to that of the toner image formed on the photosensitive drum 7, so that the toner image is transferred onto a recording material 2 from the photosensitive drum 7.

Fixing Means

The fixing means 5 functions to fix the toner image having been transferred by the voltage applied to the transfer roller 4. As shown in FIG. 1, the fixing means 5 comprises a driving roller 5*a*, and an inside heater 5*b* and a fixing roller 5*c* driven by the driving roller 5*a* by the press-contact therebetween. When the recording material having the toner image passes through a nip formed between the driving roller 5*a* and the fixing roller 5*c*, the pressure is applied by the nip between the rollers 5*a* and 5*c*, while being subjected to heat produced by the fixing roller 5*c*, by which the toner image is fixed on the recording material 2.

Process Cartridge Mounting Means

Figure 3:
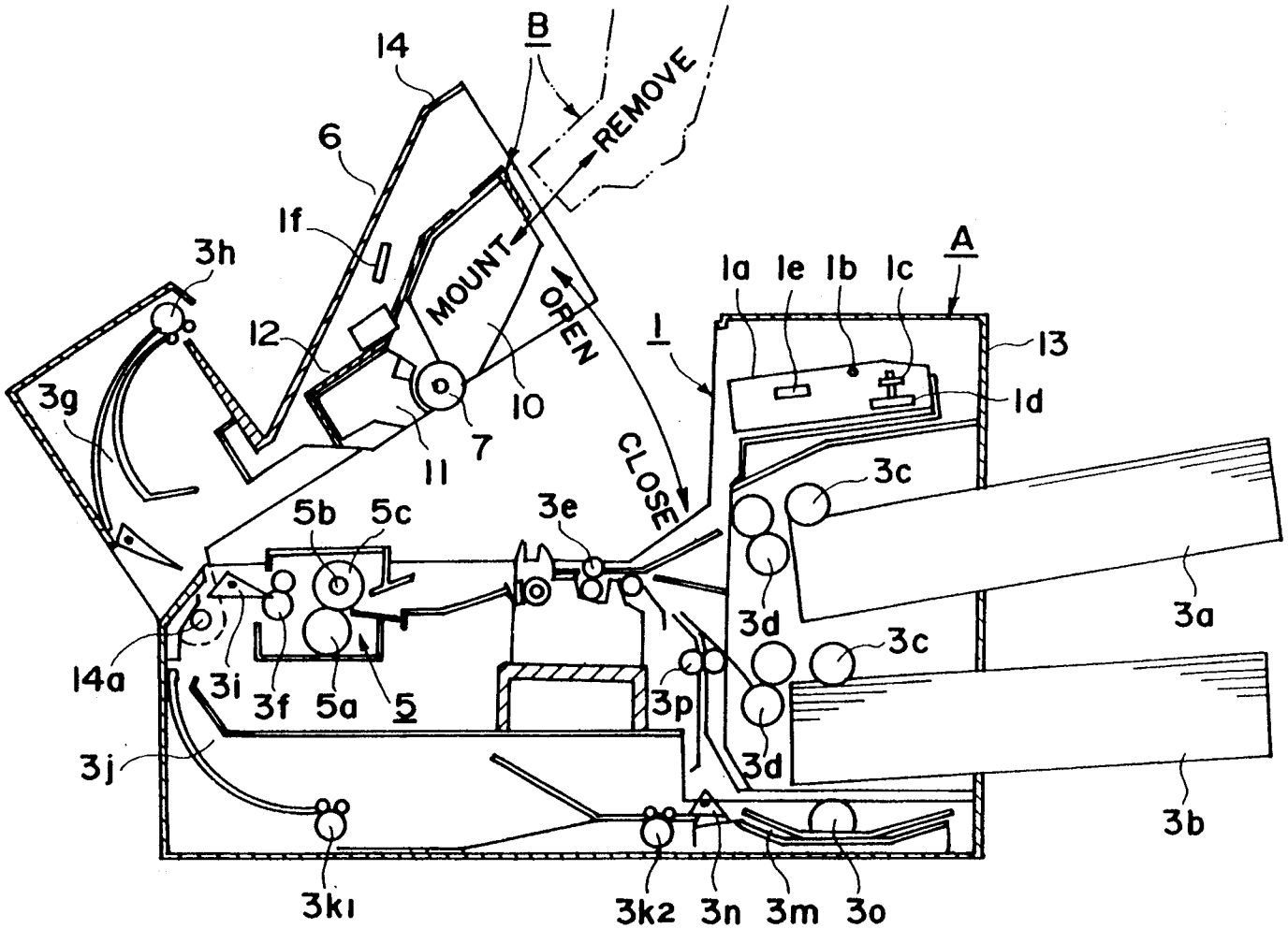
FIG. 3 is a sectional view of the image forming apparatus when it is opened.

In the image forming apparatus A, there is provided a cartridge mounting means for securedly receiving the process cartridge B. As shown in FIG. 3, the mounting or demounting of the process cartridge B relative to the main assembly 13 is effected after opening the opening member 14. The upper part of the main assembly 13 is provided with an opening member 14 operable by a hinge 14*a*. When the opening member 14 is opened, there is a cartridge guiding member (not shown) at the left and right inside surface of the opening member 14. These guiding members function as a guide for insertion of the process cartridge B. The process cartridge B is inserted along the guide, and then the opening member 14 is closed, by which the process cartridge B is mounted to the image forming apparatus A.

Process Cartridge

The description will be made as to the process cartridge B mounted to the image forming apparatus A.

This process cartridge B comprises an image bearing member and at least one processing means. As for the processing means, there are for example, a charging means for charging the surface of the image bearing member, a developing means for forming a toner image on the image bearing member, a cleaning means for cleaning the residual toner from the image bearing member surface, or the like. The process cartridge B of this embodiment comprises an electrophotographic photosensitive drum 7 as the image bearing member, a charging means 8, an exposure means 9, a developing means 10, and cleaning means 11, wherein the photosensitive drum 9 is surrounded thereby, as show in FIG. 2. These processing means are integrally contained in a housing, thus forming an exchangeable cartridge which can be loaded into or taken out of the main assembly of the apparatus.

The parts of the process cartridge B will be described in the order of photosensitive drum 7, charging means 8, exposure means 9, developing means 10 and cleaning means 11.

Photosensitive Drum

The photosensitive drum 7 in this embodiment comprises a drum base of cylindrical aluminum and an organic photoconductive layer applied thereon. The photosensitive drum 7 is mounted rotatably on the housing 12. A flange gear mounted to one longitudinal end of the drum 7 is driven by a driving force from a driving motor provided in the main assembly, by which the photosensitive drum 7 is rotated in a direction indicated by an arrow in FIG. 2 in accordance with image forming operation.

Charging Means

Charging means functions to uniformly charge the surface of the photosensitive drum 7, and in this embodiment, it is a so-called contact charging type in which a charging roller 8 is rotatably mounted on a cleaning container 12*c*. The charging roller 8 comprises a metal roller shaft 8*a*, an electroconductive elastic layer thereon, a high resistance elastic layer and a surface protection layer. The electroconductive elastic layer comprises a carbon dispersed in elastic rubber layer of EPDM or NBR or another elastic rubber layer. It is effective to introduce a bias voltage from the roller shaft 8*a*. The high resistance elastic layer is of urethane rubber or the like, and as an example, it contains a small amount of electroconductive fine powder. It is effective to limit leakage current to the photosensitive drum 7 to prevent sudden bias voltage drop even when the charging roller is contacted to a high electroconductivity portion such as a pin hole of the photosensitive drum 7. The protection layer is constituted by N-methylmethoxynylon, so that plastic material in the high resistance elastic layer or in the electroconductive elastic layer is directly contacted to the photosensitive drum 7 to deteriorate the surface of the photosensitive drum 7.

The charging roller 8 is contacted to the photosensitive drum 7, and for the image formation, the charging roller 8 is driven by the rotation of the photosensitive drum 7, and the superimposed application of the DC voltage and the AC voltage to the charging roller 8 is effective to uniformly charge the surface of the photosensitive drum 7.

Exposure Means

The exposure station 9 is effective to expose the surface of the photosensitive drum 7 uniformly charged by the charging roller 8 to light image supplied from an optical system 1, thus forming an electrostatic latent image on the surface of the drum 7. An opening 9 for introducing the light image formed in the top surface of the housing 12 constitutes the exposure means.

Developing Means

As shown in FIG. 2, the developing means 10 comprises a toner container 10*a* for containing toner, and toner feeding member 10*b* reciprocable in the direction indicated by an arrow to feed the toner, in the toner container 10*a*. Non-rotatable magnet 10*c* is provided therein. By the rotation thereof, a developing sleeve 10*d* carrying a thin toner layer, is fed to a developing zone where the developing sleeve 10*d* is spaced from a photosensitive drum 7 with a small gap.

When the toner layer is to be formed on the surface of the developing sleeve 10*d*, the toner and the developing sleeve 10*d* are contacted to triboeletrically charge the toner to a sufficient extent to develop the latent image on the photosensitive drum 7. In order to regulate the layer thickness of the toner, there is provided a blade 10*e*, as shown.

Cleaning Means

The cleaning means 11, as shown in FIG. 2, comprises a cleaning blade 11*a* for scraping toner off the drum 7 by contact to the surface thereof, a receptor sheet 11*b* disposed below the blade 11*a* lightly contacted to the surface of the photosensitive drum 7 to receive the toner scraped by the cleaning blade 11*a*, a member 11*c* for feeding to a rear part of the container the residual toner received thereby, and a residual toner container 11*d* for containing the removed residual toner.

Photosensitive Drum Mounting Member

Figure 4:
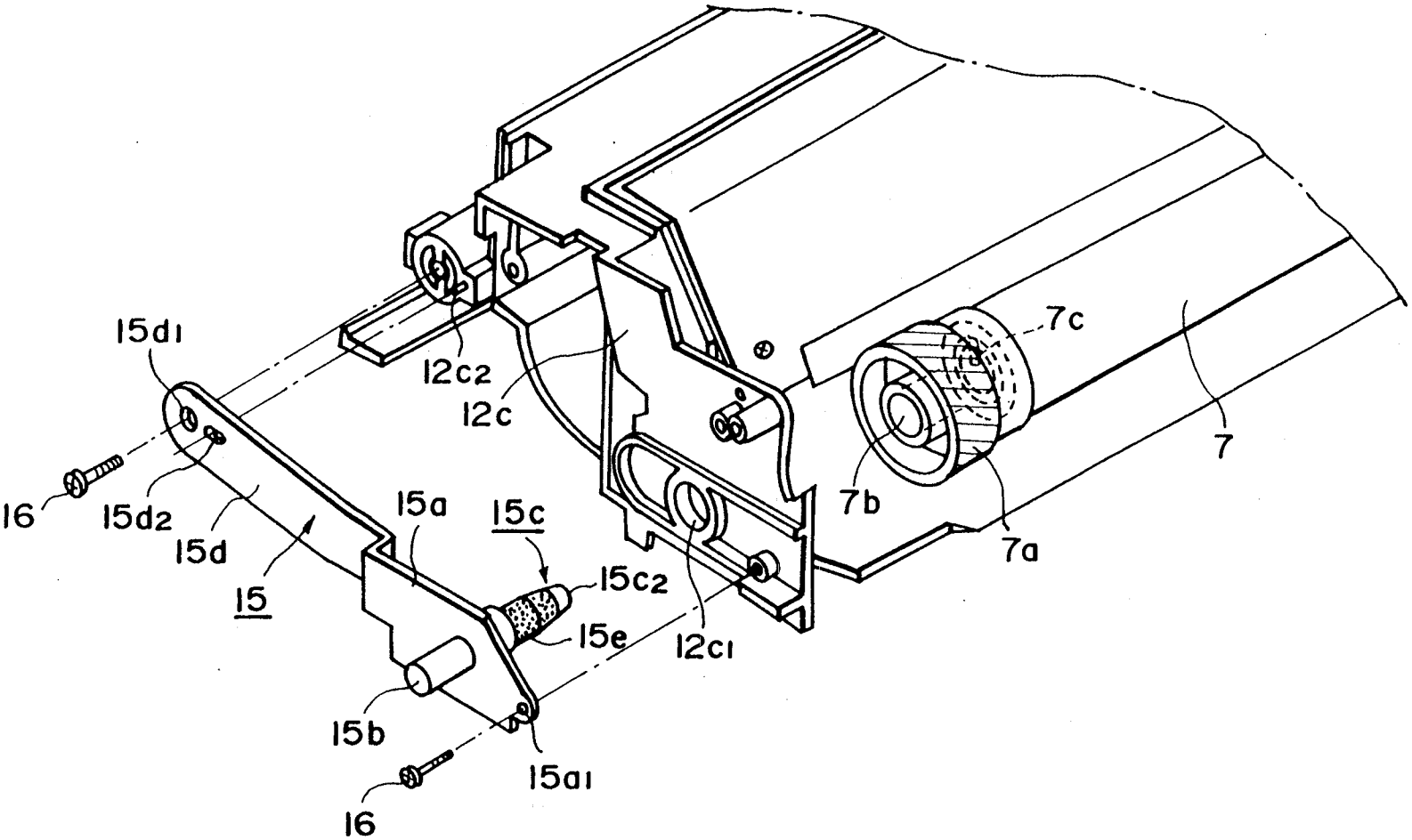
FIG. 4 illustrates a photosensitive drum mounting member.

The description will be made as to mounting member for rotatably mounting the photosensitive drum to the housing 12. As shown in FIG. 4, to one end of the cylindrical aluminum base of the photosensitive drum 7, a flange gear 7*a* is mounted. The flange gear 7*a* is injection-molded from an insulative plastic material such as polycarbonate resin or polyacetal resin or the like. It is press-fitted to the end of the drum base, or it is secured fixed by an adhesive. The supporting member 15 is inserted into a bore 7*b* formed in the flange gear 7*a* to rotatably support the photosensitive drum 7.

As shown in FIG. 4, the mounting member 15 comprises a first conductive member 15*b* projected from one side surface of the base 15*a*, and a second conductive member 15*c* projected from the other side of the base 15*a*. An extension 15*d* is extended from the base 15*a*. A plastic material cylindrical member 15*e* is mounted to an end of the second conductive member 15*c*.

The first conductive member 15*b* are electric contacts for electrically grounding the photosensitive drum 7. When the process cartridge B is mounted in the main assembly 13, the first conductive member 15*b* is contacted to a grounding contact (not shown) of the main assembly 13.

Figure 5:
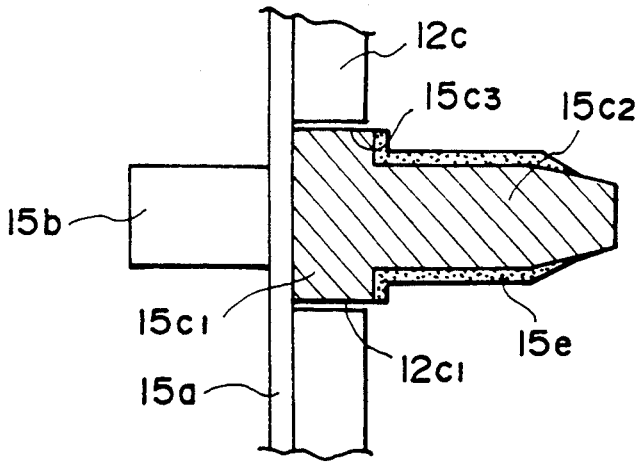
FIG. 5 is a sectional view of a second conductive member of the mounting member.

On the other hand, the second conductive member 15*c* is inserted into the bore 7*b* of the flange gear 7*a* to rotatably support the photosensitive drum 7. As shown in FIG. 5, a base portion 15*c*1 received by a bore 12*c*1 of the cleaning device 12*c*, and a shaft portion 15*c*2 received by the bore 7*b* of the flange gear 7*a*, are integrally formed through a stepped portion 15*c*3. An end of the shaft 15*c*2 is converged toward the end for easy insertion into the bore 7*b*.

When the second conductive member 15*c* is inserted into the bore 7*b* of the flange gear 7*a*, the end thereof is brought into contact with a contact 7*c* (FIG. 4) in the photosensitive drum 7, and the photosensitive drum 7 is electrically connected with the electric ground of the main assembly 13 through the second and first conductive members 15*c* and 15*b*. For this purpose, the first and second conductive members 15*b* and 15*c* are of electroconductive material. For example, it may be a steel, stainless steel, brass, aluminum or the like plated with nickel chrome. In this embodiment, the base 15*a* and the extension 15*d* are integrally formed with the first and second conductive members 15*b* and 15*c*.

The plastic cylindrical member 15*e* is made of a material exhibiting sufficient sliding property relative to the flange gear 7*a*. The examples include polyacetal, polybutylene terephthalate, polycarbonate or the like material. It may be outsert-molded on the shaft portion 15*c*2 of the second conductive member 15*c*, or a cylindrical member 15*e* is press-fitted to the shaft portion 15*c*2. Further alternatively, it may be bonded by an adhesive. When the cylindrical member 15*e* is inserted into the bore 7*b* of the flange gear 7*a*, it is contacted to the inside peripheral surface of the bore 7*b* to support the photosensitive drum 7. Therefore, when the image formation is carried out using the process cartridge B mounted, the flange gear 7*a* is in sliding contact with the plastic material cylindrical member 15*e* of the mounting member 15, and therefore, the sliding property is improved.

For this reason, the scraping of the flange gear 7*a* of the plastic material by sliding contact with the metal shaft, is prevented, as contrasted to the prior art. In addition, the noise production can be avoided.

Since the cylindrical member 15*e* is of insulative material, the current to be fed to the electric ground is prevented from flowing into the other path such as flange gear 7*a* or the like.

Figure 6A:
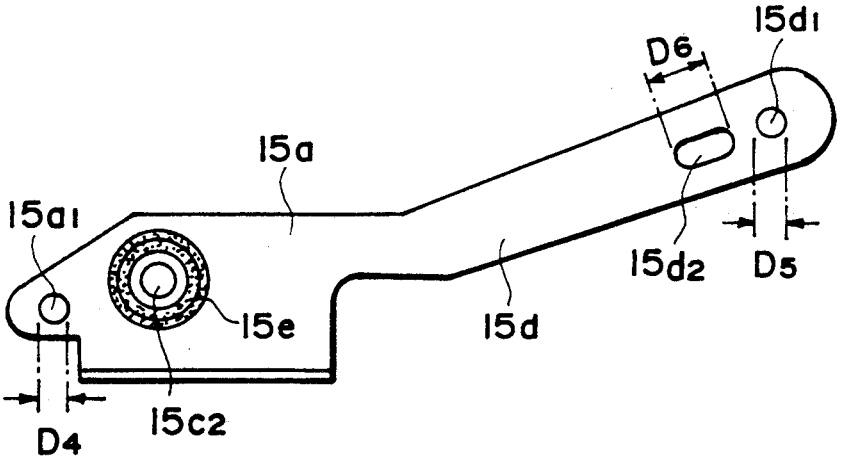
FIG. 6A is a front view of the mounting member as seen from the second conductive member.
Figure 6B:
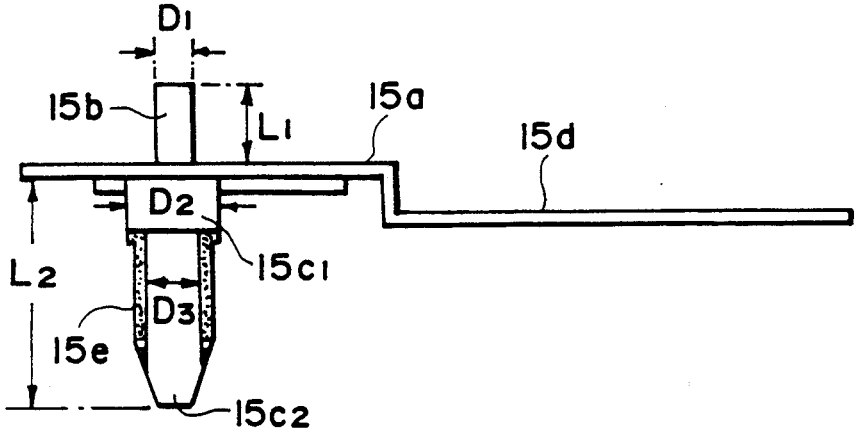
FIG. 6B is a sectional plan view.

Referring to FIG. 6, dimensions of various parts of the mounting member 15 in this embodiment will be given. FIG. 6A is a front view of the mounting member 15 as seen from the second conductive member 15*c*. FIG. 6B is a sectional plan view.

A diameter D1 of the first conductive member 15*b*: approx. 8 mm

A projected length L1 of the first conductive member 15*b* from the base 15*a*: approx. 12 mm Diameter D2 of the base portion of the second conductive member: approx. 12 mm Diameter D3 of the shaft portion of the second conductive member 15*c*: approx. 10 mm Projected length L2 of the second conductive member 15*c* from the base 15*a*: approx. 25 mm Diameter D4 of a hole 15*a*1, for screw, of the extension: approx. 4 mm Diameter D6 of an elongated hole 15*d*2: approx. 4 mm In order to mount the photosensitive drum 7 to the cleaning frame 12*c* by he mounting member 15, as shown in FIG. 4, the shaft portion 15*c*2 of the mounting member 15 is inserted into the bore 7*b* of the flange gear 7*a* mounted on the photosensitive drum 7 through a hole 12*c*1 of the cleaning container 12*c*. At this time, an end portion of the shaft portion 15*c*2 is contacted to a ground contact 7*c* in the photosensitive drum 7. An elongated hole or slot 15*d*2 in the extension 15*d* is engaged in the positioning boss 12*c*2 of the cleaning container 12*c*, and a screw 16 is threaded to the cleaning container 12*c* through the holes 15*a*1 and 15*d*2 formed in the base 15*a* and the extension 15*d*, respectively, thus securing the mounting member 15 to the cleaning container 12*c*.

Similarly, at the other longitudinal end of the photosensitive drum 7, the shaft portion of the mounting member is inserted into a bore of the flange mounted to the end of the drum. Here, the similar supporting manner may be used with the use of the mounting member 15. However, in the case of this end, the provision of the plastic material cylindrical member 15*e* is not inevitable.

Sealing Member for Toner Container

Figure 7:
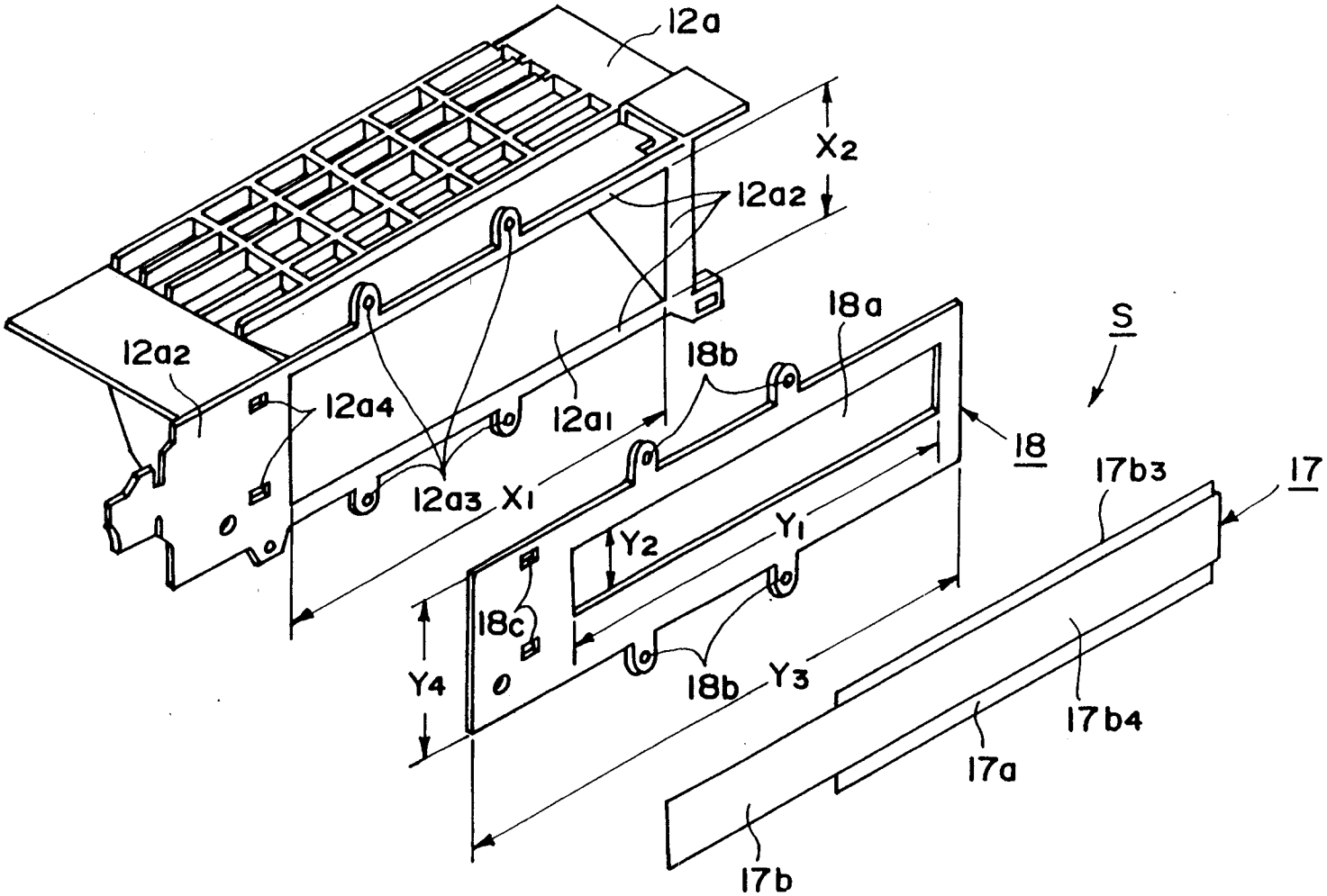
FIG. 7 is a perspective view wherein a toner container, an opening regulating member and a cover member are disassembled.

The sealing member mounted to the toner container 12*a* will be described. As shown in FIG. 7, the toner container 12*a* is provided with an opening 12*a*1 the toner contained in the container is supplied to a developing sleeve through an opening. However, when the process cartridge B is not used, the toner in the container may leak out or may be wetted during storage or transportation of the process cartridge B, if the opening 12*a*1 is open. A sealing member S is mounted to close the opening for the purpose of hermetically closing the opening 12*a*1 before use and permitting opening thereof upon use thereof.

The sealing member S comprises a cover seal 17*a* and a flexible tear tape 17*b* made integral by fusing or the like, to constitute a cover member 17. The cover member 17 is mounted to the opening limiting member 18 by fusing or the like. The limiting member 18 is mounted adjacent the opening 12*a*1 of the toner container 12*a*, by which the opening 12*a*1 is hermetically closed.

Cover Seal

Figure 8A:
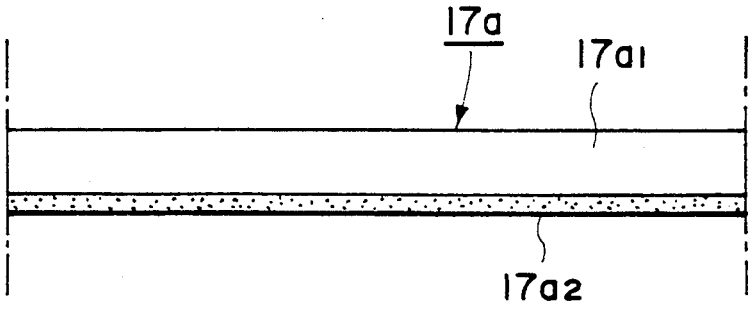
FIG. 8A is a sectional view of a cover seal.

As shown in FIG. 8A, the cover seal 17*a* comprises a base material 17*a*1 and a sealant layer 17*a*2.

The material of the base member 17*a*1 is such as to permit sufficient maintenance of sealing property of the opening of the container and to exhibit one directional tearing tendency. Examples include uniaxial oriented film material or sheet, such as uniaxial oriented polyethylene, uniaxial oriented polypropylene, uniaxial oriented foamed polypropylene materials or the like.

By the use of such a film, the force required for tearing the cover sheet 17 can be reduced, and in addition, the width of the toner opening provided by the tearing can be made uniform.

As for the base material 17*a* exhibiting stable longitudinal tearing property and exhibiting a substantial film strength, there is drawn foamed polypropylene film or the like having a film thickness of approx. 120–140 μm, an average density of 0.6 g/cc–0.9 g/cc approx., preferably. The sealant layer 17*a*2 is preferably polyethylene sealant to permit easy fusing onto the sealant layer of the tear tape 17*b* which will be described hereinafter, by heat seal (heat fusing). Another examples include vinylacetate resin, ionomer resin. Additionally, impulse sealing or high frequency welder are usable when proper materials are selected. When a polyethylene sealant containing several percent–several tens percent of ethylene-vinyl acetate copolymer material is used, the film thickness is preferably 10–30 μm in consideration of the bonding strength, further preferably, the film thickness is approx. 15–25 μm.

Tear Tape

Figure 8B:
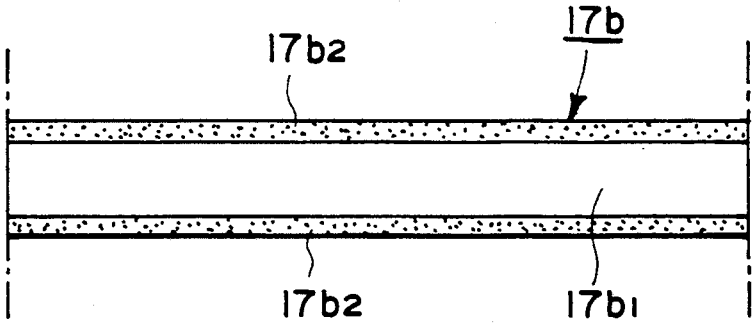
FIG. 8B is a sectional view of a tear tape.

The tear tape 17*b*, as shown in FIG. 8B, comprises a base material 17*b*1 and a sealant layer 17*b*2 at each of the front and back sides.

The material of the base member 17*b*1 is required to have sufficient strength to permit tearing of the cover seal 17*a*, more particularly, the tensile strength thereof is preferably approx. three times that of the cover seal 17*a*. Examples of usable materials include biaxial oriented polyester, biaxial oriented polypropylene, polystyrene, biaxial oriented nylon or another film or sheet material. Particularly, biaxial oriented polyester film having a film thickness of approx. 20–40 μm is preferable.

The material of the sealant layer 17*b*2 is similar to that of the sealant layer 17*a*2 of the cover seal 17*a*. When the sealant layers 17*a*2 and 17*b*2 are heat-fused for the purpose of unifying the cover seal 17*a* and the tear tape 17*b*, they are of similar materials for better fusing together therebetween. When the sealant layer 17*b*2 is of polyethylene sealant containing several–several tens percent of ethylenevinyl acetate copolymer, is used, it has preferably a film thickness of approx. 20–40 μm in consideration of the bonding strength. Further preferably, the film thickness is approx. 25–35 μm.

Figure 9:
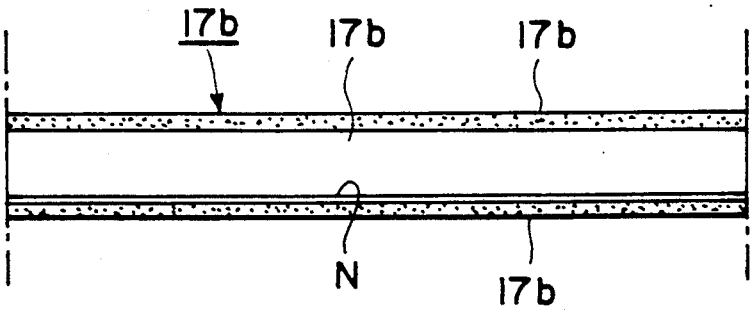
FIG. 9 illustrates a tear tape according to a further embodiment.

As for the tear tape 17*b*, as shown in FIG. 9, a nylon layer N may be provided to provide cushion property upon the heat sealing between the base material 17*b*1 and the sealant layer 17*b*2. The nylon layer N preferably has a film thickness of approx. 10–20 μm, and further preferably approx. 13–17 μm.

Figure 10:
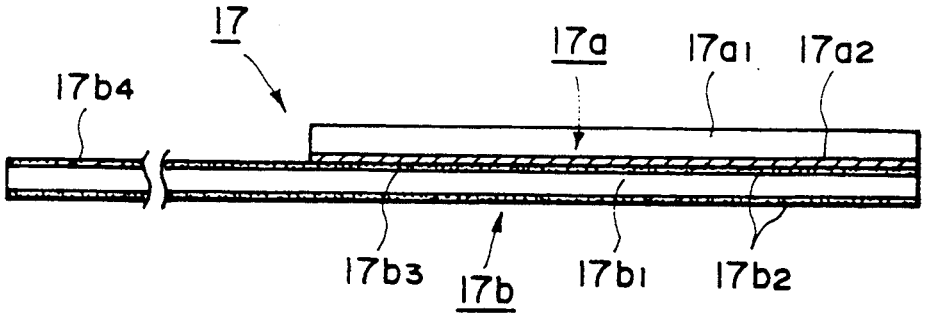
FIG. 10 is a sectional view of a cover member having integral cover seal and a tear tape.

In this embodiment, the cover seal 17*a* and the tear tape 17*b* shown in FIG. 8, are made integral by heat-sealing, as shown in FIG. 10, to constitute a cover member 17. At this time, one longitudinal end of the tear tape 17*b* is extended out of a cover seal 17*a* and constitutes a free end. The free end portion functions as a grip for pulling the cover seal 17*a* out.

Figure 11:
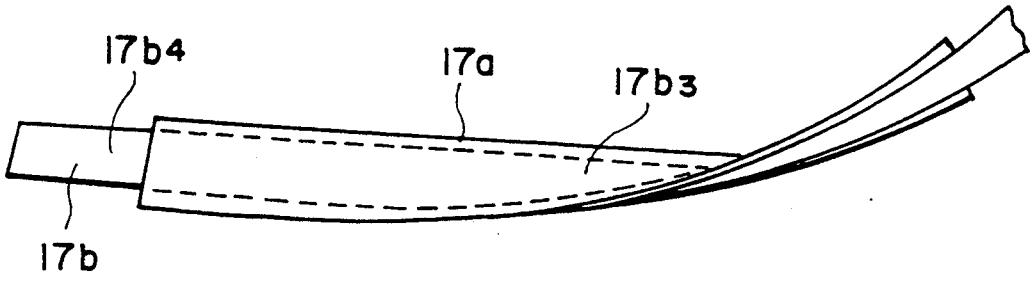
FIG. 11 illustrates a covering member which is curled.

If the thermal contraction of the base material 17*a*1 of the cover seal 17*a* is high upon the heat-fusing between the cover seal 17*a* and the tear tape 17*b*, the cover member 17 may curl as shown in FIG. 11 by the heat-pressing. If this occurs, the cover member 17 is unable to be correctly mounted to the opening limiting member 18. In order to suppress the amount of curl, the heat-contraction ratio of the base material 17*a*1 of the cover seal 17*a* is approx. 1–10 in the drawing direction, and approx. 0.1–3% in the non-drawing direction, preferably.

The heat-contraction ratio is measured when the covering member 17 is placed in a gear type hot wind oven at 120° C. for 15 min.

Opening Limiting Member

The covering member 17 is mounted to the opening portion of the opening limiting member 18 shown in FIG. 7. The opening limiting member 18 is effective to limit the width of the opening when the toner is supplied from the toner container 12*a* to the developing sleeve 10*d*. The opening limiting member 18 has a thickness of 0.3–2 mm and is of polyester plate, polystyrene plate, nylon plate, ABS plate or the like formed into a sheet. The opening 18*a* is formed by punching or molding. The opening limiting member 18 is mounted to the flange 12*a*2 around the opening 12*a*1 of the toner container by ultrasonic wave fusing or the like, and therefore, it is preferably of the same material as the container 12*a*. Therefore, if the container 12*a* is of polystyrene material, the opening limiting member 18 is also of polystyrene material.

Figure 12:
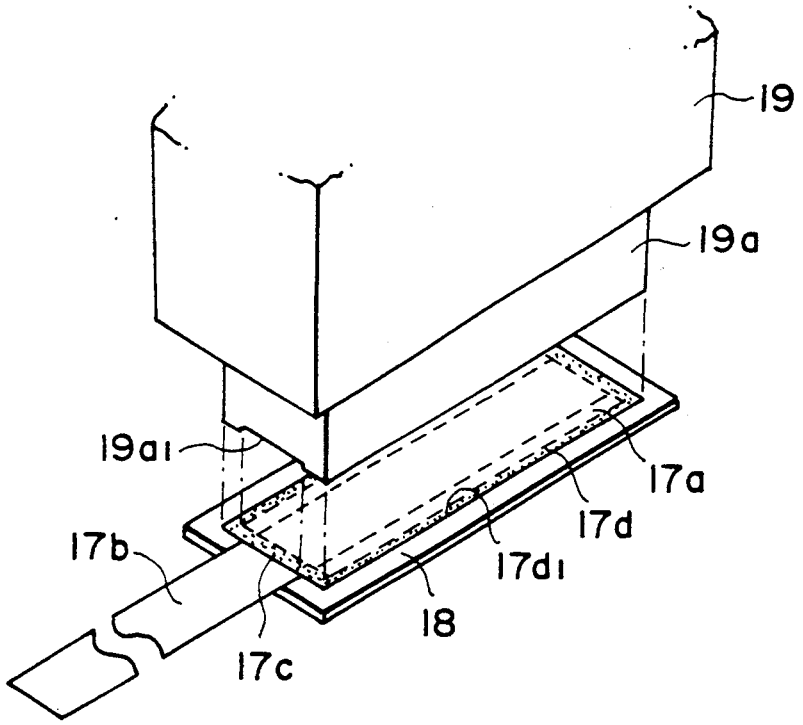
FIG. 12 illustrates fusing of a cover member to an opening regulating member.

The above-described cover member 17 is mounted to cover the opening 18*a* of the opening limiting member 18 by fusing or the like to hermetically close the opening 18*a*. As shown in FIG. 12, when the sealing is effected by the heat-press-contact, corona discharge treatment or the like is carried out for easy bonding, as desired.

As for the sealing condition, the sealing is effected with a seal bar 19*a* of a horn 19 at approx. 110° C.–130° C., a pressure of approx. 1.5 kgf/cm$^2$–5 kgf/cm$^2$ for approx. 1–3 sec. In this case, the short side overlapped portion 17*c* where the cover seal 17*a* and the tear tape 17*b* of the covering member 17 are overlapped, has a thickness larger by the thickness of the tear tape 17*b*, and therefore, a recess 19*a*1 is formed corresponding to the thickness at a portion corresponding to the seal bar 19*a*. When the thermocompression bonding is effected using seal bar 19*a*, the opening limiting member 18 and the seal bar 19*a*are maintained in parallel with each other and are uniformly press-contacted. If this is not uniform, the sealing surface 17*d* of the cover member 17 is subjected to an additional stress to such an extent that when the process cartridge B is impacted or let fall, the film is torn from an inside edge 17*d*1 of the sealing surface 17*d* with the possible result that the toner leaks out of the toner container 12*a*.

Figure 13:
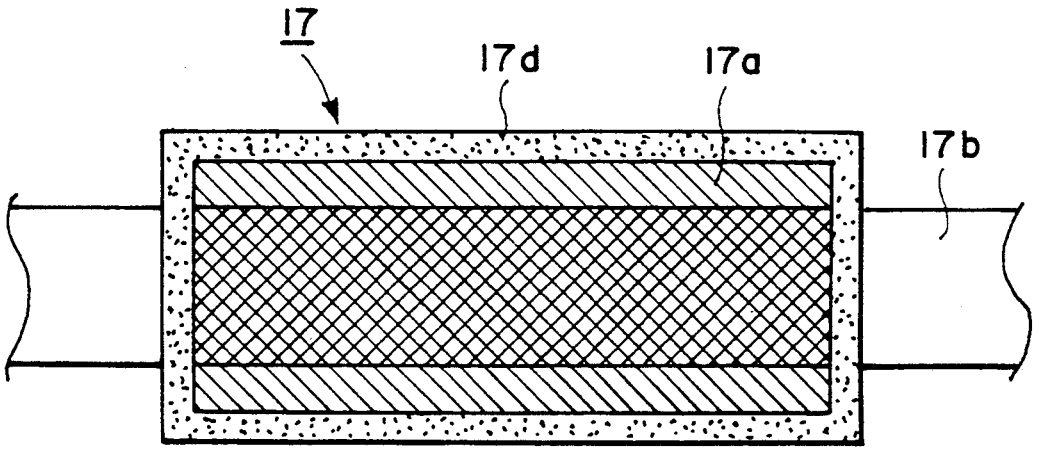
FIG. 13 illustrates a ratio of the cover seal and the tear tape.

As shown in FIG. 13, an area of overlap (dot portion) between the cover seal 17*a* and the Lear tape 17*b* excluding the sealing surface 17*d* of the cover seal 17*a* for sealing the opening 18*a* (hatched portion in FIG. 13), is preferably approx. 50–99%, further preferably approx. 70–90%. The reason is that the load at the edge portion covered only by the cover seal 17*a* is reduced with increase of the area where the cover seal 17*a* and the tear tape 17*b* are overlapped, against the inside pressure by the toner in the toner container, during the transportation. Therefore, the toner leakage due to the tearing of the seal can be assuredly prevented.

In order to effectively prevent the removal of the seal, the short side length of the tear tape 17*b* is preferably larger by 0.5–2 mm approx. than the short side length of the opening 18*a* of the opening limiting member 18, since then the pressure directly applied to the sealing surface 17*d* of the cover seal 17*a* due to the falling or pressure change or the like during transportation is reduced.

Sizes of Cover Seal and the Like

The dimensions of various members constituting the sealing member S are as follows (FIG. 7).

A longitudinal length of the cover seal 17*a*: approx. 237 mm

A short side length of the cover seal 17*a*: approx. 51.5 mm

Longitudinal length of the tear tape 17*b*: approx. 574 mm

Short side length of tear tape 17*b*: 38.5

Longitudinal length Y1 of the opening 18*a* of the opening limiting member 18: approx. 220 mm Short side length Y2 of the opening 18*a* of the opening limiting member 18: approx. 36.5 mm Longitudinal length Y3 of the opening limiting member: approx. 278.5 mm Short side length Y4 of the opening limiting member 18: approx. 77.5 mm Longitudinal length X1 of an opening 12*a*1 of the toner container 12*a*: approx. 221.5 mm Short side length X2 of opening 12*a*1 of the toner container 12*a*: approx. 63.5 mm Mounting of Sealing Member The opening limiting member 18 to which the cover member 17 is used, is mounted to the flange 12*a*2 of the toner container 12*a*, by which the toner container 12*a* is hermetically closed. Upon this mounting, the toner feeding member 10*b* is built in the toner container 12*a*, and then, the mounting is carried out. As shown in FIG. 7, an unshown tool is inserted through a positioning hole 18*b* at an end of a short side of the opening limiting member 18 and a positioning hole 12*a*3 of the toner container 12*a* to align the holes, and the opening limiting member 18 is positioned relative to the flange 12*a*2, with the positioned state, ultrasonic wave fusing or the like is carried out to complete the fusing.

Figure 14:
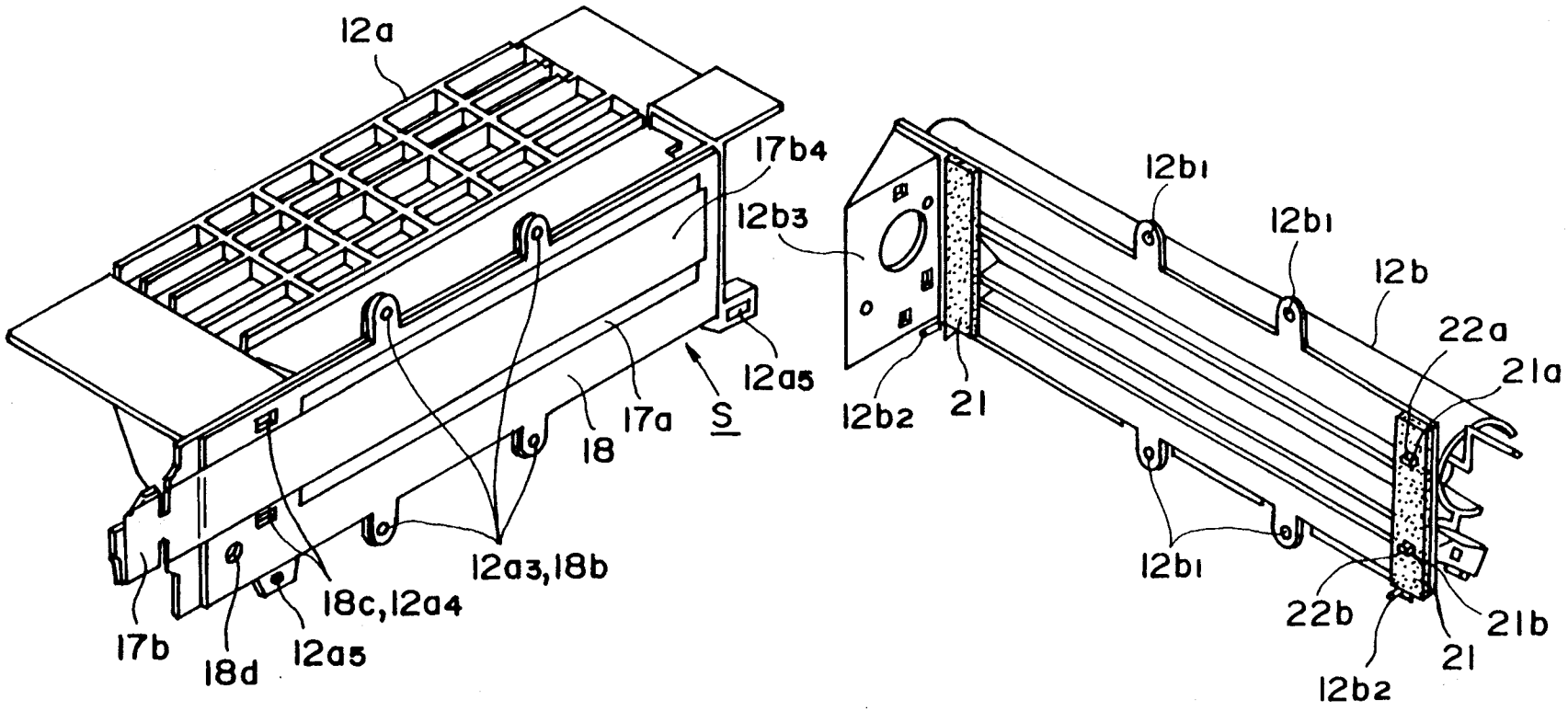
FIG. 14 illustrates mounting of a developing frame to a toner container with a sealing member.

Subsequently, a developing device frame 12*b* show in FIG. 14 is coupled with the toner container 12*a*. The developing sleeve 10*d* or developer blade 10*e* are mounted to the developing frame 12*b*. The positioning hole 12*a*3 of the toner container 12*a* having the sealing member S mounted thereto and in which the tear tape 17*b* is reversed, and the positioning hole 12*b*1 formed in the developing device frame 12*b* are inserted by an unshown tool to align the holes to correctly position the developing device frame 12*b* to the container 12*a*. With this positioned state, the ultrasonic wave fusing or the like is carried out to fuse the frame 12*b* to the opening limiting member 18, thus unifying the frame 12*b*, the sealing member S and the toner container 12*a*. As shown in FIG. 14, the tear tape 17*b* is reversed. More particularly, the tear tape 18 has a first portion 17*b*3 extended along one surface of a cover seal 17*a* and a second portion 17*b*4 disposed at the other side of the cover seal 17, extended from an end of the first portion 17*b*3 in a reverse direction.

In order to accomplish the positioning between the toner container 12*a* and the frame 12*b*, as shown in FIG. 14, positioning bosses 12*b*2 are provided at both sides of the frame 12*b*. The toner container 12*a* is provided with holes 12*a*5 engaged by the bosses 12*b*2. In FIG. 14, a wall 12*b*3 is provided at one longitudinal end of the frame 12*b* for mounting a driving unit for driving the toner feeding member or the like. Designated by reference 18*d* is a positioning hole effective when the opening limiting member 17 is mounted to the toner container 12*a*. A tab having positioning holes 12*a*3, 12*b*1 and 18*b* usable for the positioning of the developing frame 12*b* or the like, becomes unnecessary when the three parts are integrated, and therefore the tab is removed thereafter.

Figure 15:
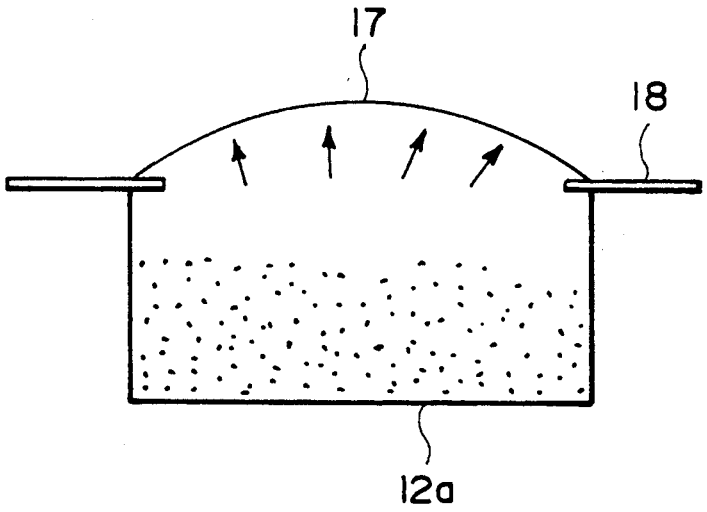
FIG. 15 illustrates pressure applied to the cover seal by an internal pressure of the toner container.
Figure 16:
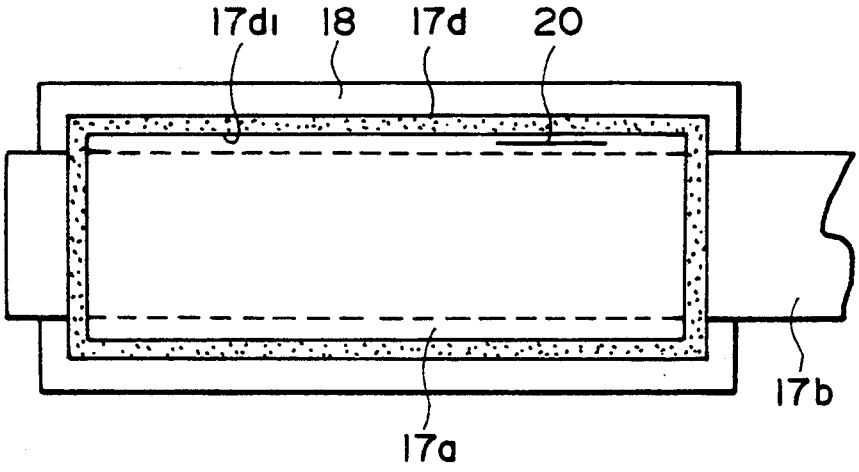
FIG. 16 illustrates a torn cover seal.
Figure 17:
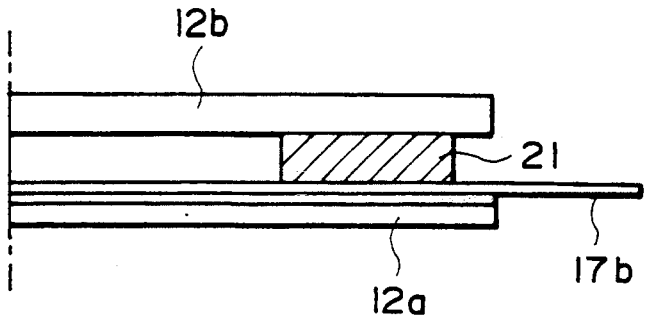
FIG. 17 is a sectional view of an example having an end seal.

In this manner, the toner is supplied through an inlet port not shown into the toner container 12*a* mounted to the developing frame 12*b*, and the port is closed. Then, the photosensitive drum 7 is assembled thereinto thus constituting the process cartridge B. Then, the process cartridge B is delivered from the plant. During the transportation, as shown in FIG. 15, the cover member 17 is subjected to load due to falling, impact or pressure change experienced by the cartridge. Then, there is a liability that the inside edge 17*d*1 portion of the sealing surface 17*d* is torn (20), as shown in FIG. 16. This is because, the cover seal 17*a* is a uniaxial oriented material, and therefore, the direction of the stress upon the thermocompression using the seal bar 19*a* is aligned with the longitudinal tearing direction, and therefore, it is relatively easily torn as contrasted to the non-drawn direction.

To avoid the liability, the durability against the tearing of the base material 17*a*1 of the cover seal 17*a* is important. It is preferably approx. 1.0–3.0 kgf/mm in the non-drawing direction, further preferably it is 1.3–3.0 kgf/mm. The film thickness of the base material 17*a*1 of the cover seal 17*a* is preferably approx. 130–150 μm.

With the above-described process cartridge B, the tear tape 17*b* is pulled out so that the cover seal 17*a* is torn, by which the sealing member S is opened, before the use thereof. In order to prevent the toner leakage between the toner container 12*a* and the developing device frame 12*b*, adjacent the longitudinal ends of the developing film 12*b*, end seals 21 of foamed polyurethane material or the like are bonded to the backside of the developing device frame 12*b*.

The end seal 28 has usually a thickness of approx. 2–5 mm, and after the coupling between the frame 12*b* and the toner container 12*a*, it is compressed to a thickness of approx. one half or one third, so that the toner leakage after the opening is prevented.

However, the force required for pulling the tear tape 17 upon the start of the use is increased by the end seal 21, and in addition, the torn end of the cover seal 17*a* becomes fuzzy or non-smooth because of the friction with the end seal 21. The reason for this is as follows. If the fusing between the sealant layer 17*a*2 of the cover seal 17*a* and the sealant layer 17*b* of the tear tape 17*b* is not complete, the cover seal 17*a* is torn approx. 2–3 mm larger in width than the tearing width of the tear tape 17*b*. This is the reason for the fuzziness. Therefore, the material of the sealant layer 17*a*2 of the cover seal 17*a* is the same as or similar to that of the sealant layer 17*b*2 of the tear tape 17*b*.

If the pulling direction of the tear tape 17 is improper when the tear tape 17*b* is pulled by a user prior to the start of the use of the process cartridge, and pulling force is significantly increased even to the worst extent that the tear tape 17*b* becomes unable to be pulled out.

Figure 18:
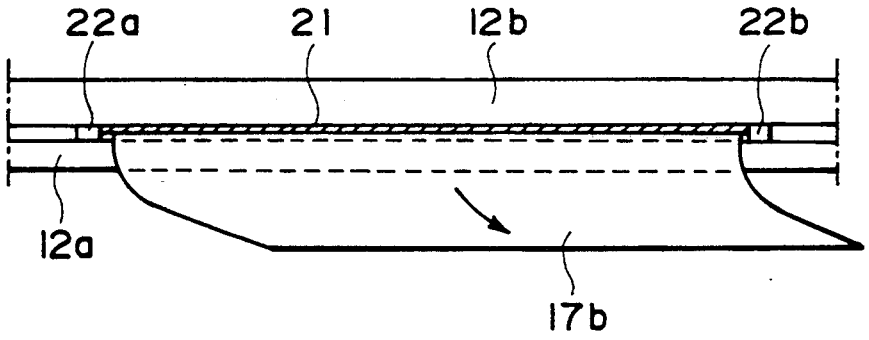
FIG. 18 illustrates a limiting boss for limiting pulling of the tear tape.

In view of this, in this embodiment, as shown in FIGS. 14 and 18, bosses 22*a* and 22*b* functioning as regulating member for the pulling are provided with a space slightly larger than the width of the tear tape 19*b*. The bosses 22*a* and 22*b* are inserted into holes 18*c* and 12*a*4 formed in the opening limiting member 18 and the toner container 12*a*, when the frame 12*b* and the toner container 12*a* are coupled. In this embodiment, the space between the bosses 22*a* and 22*b* is approx. 41.5 mm and are placed at approx. 1–3 mm away from lateral ends of the tear tape 17*b*, respectively.

By the provision of the bosses 22*a* and 22*b*, as shown in FIG. 18, even if the operator erroneously pulls the tear tape 17*b* in an inclined direction, the bosses 22*a* and 22*b* function as guiding the lateral ends of the tear tape 17*b* to permit smooth pulling in the opening direction. If the tear tape 17*b* is inclinedly pulled, the friction resistance is imparted between the tape 17*b* and the bosses 22*a* and 22*b*, and therefore, the user will be notified of the wrong direction pulling of the tear tape 17*b*.

In this embodiment, the bosses 22*a* and 22*b* are provided on the frame 12*b*, and the holes 12*a*4 are formed in the toner container 12*b*. Conversely however, the toner container 12*a* may be provided with bosses, and the frame 12*b* is provided with holes engaged thereby, with the same advantageous effects.

Results of Experiments

The results of experiments as to the strength against pulling or the like after producing various cover seal and tear tapes, will be described.

Experiment 1

Two kinds of cover seals 17*a* are prepared. The base materials 17*a*1 are 120 and 140 μm thick, respectively. They are coated with sealant layer 17*a*2 of ethylene-vinyl acetate (EVA) of the same material having a thickness of 20 μm, by dry lamination. As shown in FIG. 9, it is heat-sealed with the tear tape 17*b*, thus producing two kinds of covering members 17.

The tear tape 17*b* comprises a base material 17*b*1 of biaxial oriented polyester film having a thickness of 38 μm, a scalant layer 17*b*2 (EVA) having a thickness of 30 μm, and a drawn nylon layer N having a thickness of 15 μm as a cushion layer.

The heat seal conditions are 115° C., 2.8 kg/cm$^2$ and 3 sec. The size of the cover seal 17*a* is 48.0×237 mm, and the size of the tear tape 17*b* is 37.5×575 mm.

The cover members 12 each of the two kinds of covering members 17 is heat-seal mounted on a seal surface of the opening limiting member 18 of polystyrene plate having an opening 18*a* of 36.5 mm×220 mm and a thickness of 0.5 mm, after corona discharge treatment. Thus, the sealing member S of the toner container 12*a* is produced. The heat seal conditions are 140° C., 3.0 kg/cm$^2$, 5.5 sec. It has been confirmed that the parallelism between the seal bar 19*a* and the seal surface of the opening limiting member 18 is correctly maintained, and thereafter, the heat sealing is carried out.

Thereafter, the opening limiting member 18 having the cover member 17 is fused to the flange 12*a*2 of the toner container 12*a* by ultrasonic wave. In this manner, two kinds of toner containers 12*a* are manufactured. These are called Example 1 and Example 2.

As a Comparison Example, in place of the cover seal 17, the use is made with a conventional easy peel film, and the opening limiting member 18 is sealed thereby. Then, the opening limiting member 18 is securedly fixed by ultrasonic wave fusing. In this manner, a toner container of Comparison Example 1 was manufactured. The easy peel film comprises a first base material having a thickness of 16 μm, a second base material having a thickness of 25 μm, a cushion layer having a thickness of 20 μm, EVP sealant layer having a thickness of 30 μm. The first base material and the second base materials are of polyethylene terephthalate and cushion layer is of low molecular weight polyethylene having an average molecular weight of approx. 10,000.

With respect to the three toner containers, the force required for pulling the tear tape, that is, the strength against the pulling, in the direction of 180° C. has been measured. The drawing speed is approx. 3000 mm/min.

As will be understood from FIG. 19, the pulling force is small in Examples 1 and 2, and it is quite high in Comparison Example 1.

Additionally, each of the three toner container is coupled with a developing device frame 12*b* provided with pulling direction limiting bosses 22*a* and 22*b*, by ultrasonic wave fusing, so that three process cartridges are manufactured.

An end seal 21 of foamed polyurethane material is set in the process cartridge after it is opened. By this, the toner leakage from the process cartridge after it is opened is prevented upon, for example, the cartridge is taken out upon occurrence of troubles such as paper jam or the like. In view of the balance with this effect and the pulling force, the thickness thereof is 3 mm.

FIG. 20 shows the results at the pulling speed of approx. 3000 mm/min. for the respective process cartridges.

As will be understood from FIG. 20, the required force is very low in Examples 1 and 2, and therefore, the operativity is good. On the other hand, in the case of the process cartridge of Comparison Example 1 using the easy peel film exhibited very high force required, and therefore, the operativity is poor even to such an extent that a user is unable to open it.

Experiment 2

The Examples 1 and 2 are used with modification that the size of the opening is 60 mm×220 mm, the size of the cover seal 17*a* is 71.5 mm×237 mm, and the size of the tear tape 17*b* is 61.5 mm×575 mm. Similarly to Experiment 1, the toner containers 12*a* and the process cartridges B are manufactured. They are called Example 3 and Example 4, respectively.

As a Comparison Example 2, in place of the covering member 17, the easy peel film used in Comparison Example 1 is used with size change to match the size of the opening of the opening limiting member 18. In the similar manner, the toner container and process cartridge are manufactured.

Using the three kinds of toner accommodating containers and process cartridges, the pulling force test and pressure durability test are carried out, and after 550 g of toner is loaded, the falling test is carried out. FIGS. 21 and 22 show the results.

In the pressure durability test, the conditions are as follows. The pressure is increased at each 0.05 kgf/cm$^2$ with 5 sec. maintenance of the pressure, and the test is continued until the cover member punctures by the internal pressure. The conditions of the falling tests are as follows. Three are let fall from the height of 60 cm in two modes, i.e., 1-corner 3-edge and 6-side mode and 6-side 4-corner mode. For one lot, 10 falling tests are carried out, and the toner leakage from the covering member is checked.

As will be understood from FIGS. 21 and 22, recording the tear tape pulling strength and the opening strength, the Examples 3 and 4 are satisfactory, and there arises no problem even if the width of the opening 18*a* of the opening limiting member 18 is increased to 60 mm approx. However, as to the Comparison Example 2, the operativity of the tear tape is very poor so that an ordinary user is unable to open it.

As regards pressure durability and falling tests, the pressure durability is high enough in Examples 3 and 4, and no problem arises in the falling test. With the Comparison Example 2, the bonding strength of the seal is not enough with the result of toner leakage when the width of the opening 18*a* is increased as in this case.

As regards Examples 3 and 4, as will be apparent from the foregoing results, the sealing property of the cover seal 17*a* is good enough, and the tear tape 17*b* has a width larger than the opening width of the limiting member 18, and therefore, the pressure directly applied to the sealing surface of the cover seal 17*a* is reduced, that is, there are significant advantageous effects from the standpoint of pressure durability, falling or other transportation ambience.

Experiment 3

This is a modification of Examples 3 and 4. The size of the opening of the limiting member 18 is 60 mm×220 mm, and the size of the cover seal 17*a* is 71.5 mm×237 mm, as in Examples 3 and 4. The size of the tear tape 17*b* is 37.5 mm×575 mm. Similarly to Examples 3 and 4, the toner containers and the process cartridges are manufactured. They are called Examples 5 and 6, respectively.

This experiments have been carried out to check whether the opening width can be assuredly limited by the tear tape 17*b*, when the opening width 17*a* of the limiting member 18 is larger than the opening width of the developing device.

The tear tape is pulled at a speed of approx. 3000 mm/min, and the tearing expansion of the cover seal 17*a* after the opening, the fuzziness at the end surface of the cover seal 17*a* upon the opening, that is, the stability of the tearing, are checked. The results are shown in FIG. 23.

As will be understood from FIG. 23, the tearing expansion of the cover seal 12*a* upon the opening is not more than 1 mm for both of them, and therefore, the opening width to the developing device is sufficiently limited, and the tearing stability is satisfactory.

The process cartridge is set in the main assembly of the apparatus, and the influence to the image is checked, and it has been confirmed that the toner discharging property is very good without any problem on the image.

From the foregoing, it has been confirmed that even when the opening width of the limiting member 18 is larger than the opening width of the developing device, the width of the opening of the developing device frame to the developing device is assuredly limited by the tear tape 17*b*.

When the conventional easy peel film is used, the opening width to the developing device can not be limited by the sealing member.

Experiment 4

For each of three kinds of process cartridges manufactured in accordance with Examples 1 and 2 and Comparison Example 1, 100 process cartridges are manufactured. The tear tape is pulled at a pulling speed of approx. 3000 mm/sec, and the process cartridge is disassembled after the opening, and the seal surface on the limiting member 18 is checked as to whether the residual sealant remains or not.

The opened process cartridge is set in the main apparatus, and it has been checked whether improper image formation with white stripes or the like occurs by introduction of the residual sealant into the toner or not. The results are shown in FIG. 24.

As will be understood from FIG. 24, no residual sealant or no improper image formation is observed with respect to Examples 1 and 2, but in Comparison Example 1, 5 cartridges out of 100 cartridges involved the residual sealant. Among five cartridges, the improper image formation caused thereby occurs in 3 process cartridges.

Other Embodiments

The process cartridge B of this embodiment is not limited to monochromatic image formation, but is applicable to a cartridge for multi-color image formation (two colors, three colors or full colors) using a plurality of developing means.

In the foregoing embodiment, the photosensitive layer of the image bearing member is of an organic photoconductor (OPC), but the present invention is not limited to this case. For example, it may be amorphous silicon (A-Si), selenium (Se), zinc oxide (ZnO) or cadmium sulfide (CdS) or the like. The shape of the image bearing member is not limited to a drum, but may be a belt.

As for the developing method, a known two-component magnetic brush developing method, a cascade developing method, a touch-down developing method, cloud developing method or another developing method is usable.

As for the charging means, in the foregoing embodiment, a so-called contact type charging method is used, but another known structure is usable. For example, metal shield of aluminum or the like is disposed to enclosed three sides of a tungsten wire, which is supplied with a high voltage, thus producing positive or negative ions to the surface of the photosensitive drum so as to uniformly charge the surface of the drum.

The charging means may be a blade type (charging blade), pad type, block type, rod type or wire type.

As to the cleaning method for the toner remaining on the photosensitive drum, a blade, a fur brush, a magnetic brush or the like may be used.

The process cartridge described hereinbefore comprises an image bearing member in the form of an electrophotographic photosensitive member, for example, and at least one process means. Therefore, other process cartridges are as follows. An image bearing member and charging member are unified into a cartridge detachably mountable to the main assembly of the apparatus. An image bearing member and developing means are unified into a cartridge, which is detachably mountable to a main assembly of the apparatus. An image bearing member and cleaning means are unified into a cartridge, which is detachably mountable to a main assembly of the apparatus. An image bearing member and two or more process means are unified into a cartridge, which is detachably mountable to a main assembly of the apparatus. An image bearing member, charging means, developing means and/or cleaning means may be unified into a cartridge, which is detachably mountable to a main assembly of the apparatus.

The mounting member 15 for the photosensitive drum may be used in the case that the photosensitive drum is directly supported in the main assembly of the apparatus, as well as in the process cartridge.

In the foregoing, the toner container sealed by the sealing member S is a process cartridge as an example. The present invention is applicable to a toner replenishing type in which the toner container directly supplies the toner into the toner container in the main assembly of the apparatus.

In the foregoing, the image forming apparatus has been in the form of a laser beam printer, but the present invention is not limited to this, and is applicable to an LED printer, an electrophotographic copying machine, a facsimile machine, a word processor or another image forming apparatus.

As described in the foregoing, according to the present invention, the operativity in removing the sealing member is improved while leakage of the developer is prevented, in a developing apparatus, a process cartridge and an image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. A photosensitive drum mounting member, comprising:

a base member;

a first conductive member projected from one side of said base member;

a second conductive member, projected from the other side of said base member, and electrically connected with said first conductive member;

a cylindrical member of plastic material on a surface of said second conductive member, said cylindrical member covering an inside part of said second conductive member from its end; and an extension from said base member.

2. A member according to claim 1, wherein said first conductive member and said second conductive member are integrally formed.

3. A member according to claim 2, wherein said first conductive member is in the form of a column.

4. A member according to claim 3, wherein said second conductive member is converged toward the end.

5. A member according to claim 4, wherein said first and second conductive members are of steel, stainless steel, brass or aluminum plated with nickelchrome.

6. A member according to claim 3, wherein said first conductive member is projected from said base member, and a length of projection is approx. 12 mm, and the column has a diameter of approx. 8 mm.

7. A member according to claim 4, wherein said second conductive member is projected from said base member, and a length of projection is approx. 25 mm.

8. A member according to claim 4, wherein said cylindrical member is mounted to said second conductive member by outsert-molding.

9. A member according to claim 4, wherein said cylindrical member is mounted to said second conductive member by press-filling.

10. A member according to claim 8 or 9, wherein said cylindrical member is of polyacetal resin material, polybutylene terephthalate resin material or polycarbonate resin material.

11. A member according to claim 1, wherein said base member and said extension are integrally formed.

12. A member according to claim 1, wherein said base member and said extension are provided with holes for a screw for mounting said mounting member to a member to be mounted.

13. A mounting method for mounting a photosensitive drum to a member to be mounted, comprising:

preparing a photosensitive drum mounting member including a base member; a first conductive member projected from one side of said base member; a second conductive member, projected from the other side of said base member, and electrically connected with said first conductive member; a cylindrical member of plastic material on a surface of said second conductive member, said cylindrical member covering an inside part of said second conductive member from its end; an extension from said base member;

preparing a photosensitive drum having a photosensitive member, a flange at one end of said photosensitive drum and a conductive member inside said flange, said conductive member is electrically connected with said photosensitive drum;

engaging the cylindrical member of the mounting member to an inside part of the flange of the photosensitive drum; and contacting said second conductive member and said conductive member; and then mounting said mounting member to the member to be mounted, by which said photosensitive drum is rotatably mounted to the member to be mounted.

14. A method according to claim 13, wherein said flange is electrically insulative.

15. A method according to claim 13, wherein said photosensitive drum is an electrophotographic photosensitive drum, and the other end thereof is supported on a drum supporting shaft, so that it is rotatably mounted to the member to be mounted.

16. A process cartridge detachably mountable to a main assembly of an image forming apparatus, comprising:

a frame;

an electrophotographic photosensitive drum having a photosensitive layer, a flange at an end thereof and a conductive member inside the flange, said conductive member being electrically connected with the drum;

process means actable on said photosensitive layer;

a photosensitive drum mounting member including a base member; a first conductive member projected from one side of said base member; a second conductive member, projected from the other side of said base member, and electrically connected with said first conductive member; a cylindrical member of plastic material on a surface of said second conductive member, said cylindrical member covering an inside part of said second conductive member from its end; and an extension from said base member;

wherein the plastic material cylindrical member of said mounting member is engaged to an inside part of said flange of said photosensitive drum, and said photosensitive drum is rotatably mounted to said frame.

17. A process cartridge according to claim 16, wherein said process cartridge comprises charging means, developing means or cleaning means and said photosensitive member, as a unit.

18. A process cartridge according to claim 16, wherein said process cartridge contains at least one of charging means, developing means and cleaning means and said photosensitive drum.

19. A process cartridge according to claim 16, wherein said process cartridge contains at least developing means and said photosensitive member.

20. An image forming apparatus usable with a process cartridge detachably mountable thereto, comprising:

an electrophotographic photosensitive drum;

a photosensitive drum mounting member including a base member; a first conductive member projected from one side of said base member; a second conductive member, projected from the other side of said base member, and electrically connected with said first conductive member; a cylindrical member of plastic material on a surface of said second conductive member, said cylindrical member covering an inside part of said second conductive member from its end; an extension from said base member;

process means actable on said photosensitive drum; and feeding means for feeding a recording material on which an image is formed.

21. An apparatus according to claim 20, wherein said image forming apparatus includes an electrophotographic copying machine.

22. An apparatus according to claim 20, wherein said image forming apparatus includes a laser beam printer.

23. An apparatus according to claim 20, wherein said image forming apparatus includes a facsimile machine.

* * * * *

UNITED STATES PATENT AND TRADEMARK OFFICE

CERTIFICATE OF CORRECTION

PATENT NO. : 5,446,525 Page 1 of 3

DATED : August 29, 1995

INVENTOR(S) : Hiroo KOBAYASHI

It is certified that error appears in the above-indentified patent and that said Letters Patent is hereby corrected as shown below:

COLUMN 3:

Line 47, Q: "products" should read --produces--.

COLUMN 4:

Line 32, "(Transfer means)." should be deleted; between lines 32 and 33, --Transfer Means-- should be inserted and centered.

COLUMN 10:

Line 33, "19aare" should read --19a are--;
Line 42, "Lear" should read --tear--.

COLUMN 11:

Line 31, "show" should read --shown--.

UNITED STATES PATENT AND TRADEMARK OFFICE

CERTIFICATE OF CORRECTION

PATENT NO. : 5,446,525

DATED : August 29, 1995

INVENTOR(S) : Hiroo KOBAYASHI

It is certified that error appears in the above-indentified patent and that said Letters Patent is hereby corrected as shown below:

COLUMN 14:

Line 4, "container" should read --containers--;
Line 23, "force" should read --force is--.

COLUMN 17:

Line 27, "material" should read --material formed--;
Line 29, "an inside part" should read --an inboard portion relative to a distal end--;
Line 30, "from its end" should be deleted;
Line 36, "column." should read --shaft.--;
Line 45, "column" should read --shaft--.

COLUMN 18:

Line 5, "material" should read --material formed--;
Line 7, "an inside part" should read --an inboard portion relative to an distal end--;
Line 8, "from its end" should be deleted;
Line 46, "material" should read --material formed--;
Line 48, "an inside part" should read --an inboard portion relative to a distal end--;
Line 49, "from its end" should be deleted.

UNITED STATES PATENT AND TRADEMARK OFFICE

CERTIFICATE OF CORRECTION

PATENT NO. : 5,446,525 Page 3 of 3

DATED : August 29, 1995

INVENTOR(S) : Hiroo KOBAYASHI

It is certified that error appears in the above-indentified patent and that said Letters Patent is hereby corrected as shown below:

COLUMN 19:

Line 8, "material" should read --material formed--;

Line 10, "an inside part" should read --an inboard portion relative to a distal end--;

Line 11, "from its end" should be deleted.

Signed and Sealed this

Twenty-eighth Day of May, 1996

Bruce Lehman

*Attest:*

BRUCE LEHMAN

*Attesting Officer*

*Commissioner of Patents and Trademarks*